United States Patent [19]

Rozmus

[11] 4,383,884

[45] May 17, 1983

[54] CLOSED LOOP LEACHING SYSTEM

[75] Inventor: Walter J. Rozmus, Traverse City, Mich.

[73] Assignee: Kelsey-Hayes Company, Romulus, Mich.

[21] Appl. No.: 268,878

[22] Filed: Jun. 1, 1981

[51] Int. Cl.[3] ..... C23F 1/02

[52] U.S. Cl. ..... 156/642; 75/101 R; 134/3; 134/10; 134/41; 156/345; 156/630; 156/634; 156/656; 423/658.5

[58] Field of Search ..... 75/101 R, 109; 134/3, 134/41, 10, 11, 12, 103, 105, 108, 109; 156/630, 634, 642, 655, 656, 345; 423/658.5

[56] References Cited

U.S. PATENT DOCUMENTS

| | | | |
|---|---|---|---|
| 2,235,658 | 3/1941 | Waterman | 156/642 X |
| 2,516,930 | 8/1950 | Varian | 156/656 X |
| 3,192,084 | 6/1965 | Vaughen et al. | 156/656 X |
| 3,261,733 | 7/1966 | Bellinger | 156/656 |
| 3,443,991 | 5/1969 | Kremm | 156/642 X |
| 3,737,367 | 6/1973 | Roberts et al. | 156/655 X |

*Primary Examiner*—William A. Powell

*Attorney, Agent, or Firm*—Harold W. Milton, Jr.

[57] ABSTRACT

A closed loop assembly for dissolving a layer from an article by exposing the article to a leaching solution having a predetermined boiling temperature. The assembly includes a sealed reaction container including an inner compartment to contain the leaching solution and the article, a recirculation system connected to the reaction container for receiving boiled off leaching solution vapor and condensing the vapor and returning the vapor to the reaction container, and a heater for heating the article within the reaction container above the boiling temperature of the leaching solution.

The assembly performs a method of dissolving the layer from an article by exposing the article to the leaching solution. The steps include placing the article in the inner compartment of the sealed reaction container containing the leaching solution, heating the article to a temperature above the boiling temperature of the leaching solution to increase the corrosion rate of the outer layer of the article, conducting and condensing boiled off leaching solution vapor in the recirculation system, and selectively returning the collected leaching solution to the reaction container.

20 Claims, 3 Drawing Figures

CLOSED LOOP LEACHING SYSTEM

BACKGROUND OF THE INVENTION (1) Field of the Invention

The subject invention relates to a leaching assembly and method for dissolving an outer layer from an article.

(2) Description of the Prior Art

Several methods have been devised for consolidating powder metal. In one method, a thick-walled container of the powder metal is hot-consolidated by the application of heat and pressure, either by means of an autoclave or by a mechanical press. Subsequent to hot consolidation it is necessary to remove the container from the consolidated powder metal. Generally, the removal of the container is accomplished by a combination of a machining and a leaching operation.

Prior art leaching operations have proceeded at a very slow rate. The instant invention provides an improved leaching apparatus and method which is capable of removing the low carbon steel container material at a much faster rate than methods previously employed.

SUMMARY OF THE INVENTION

A closed loop assembly dissolves an outer layer from an article by exposing the article to a leaching solution having a predetermined boiling temperature. The assembly includes a sealed reaction container having an inner compartment adapted to contain the leaching solution and the article. A recirculation system is connected to the reaction container for receiving boiled off leaching solution vapor and reaction gaseous products and condensing the vapor and returning the vapor to the reaction container as a secondary feature. A heater is included for heating the article within the reaction container above the boiling temperature of the leaching solution to increase the corrosion rate of the article.

The invention also includes a method of dissolving the outer layer from the article including the steps of placing the article in the inner compartment of the sealed reaction container containing the leaching solution, heating the article to a temperature above the boiling temperature of the leaching solution to increase the corrosion rate of the outer layer of the article, conducting and condensing boiled off leaching solution vapor in a recirculation system, and selectively returning the collected leaching solution to the reaction container.

PRIOR ART STATEMENT

The U.S. Pat. No. 3,261,733 to Bellinger issued July 19, 1966 teaches a method of dissolving a metal core in an etching bath wherein the metal core may be a low carbon steel and the etching bath is a nitric acid solution. Cooling coils are used for controlling frothing of a reaction mixture and scrubbers are used for cleaning the fumes generated by the reaction.

The U.S. Pat. No. 2,235,658 to Waterman issued Mar. 18, 1941 teaches the use of an acid solution which is reclaimed by continuously draining the acid solution and precipitate from the reaction vessel and conducting it to a still apparatus in which the agent is boiled off. The vapor then passes through a condenser including a cooling coil and the condenser agent is returned to the reaction vessel.

Neither of the above-cited patents teaches a closed loop leaching system in which vapor generated by boiling the acid solution is collected, condensed, and returned to the reaction vessel. Additionally, neither patent teaches the method of heating a workpiece to a temperature above the boiling temperature of the leaching solution to increase the corrosion rate.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
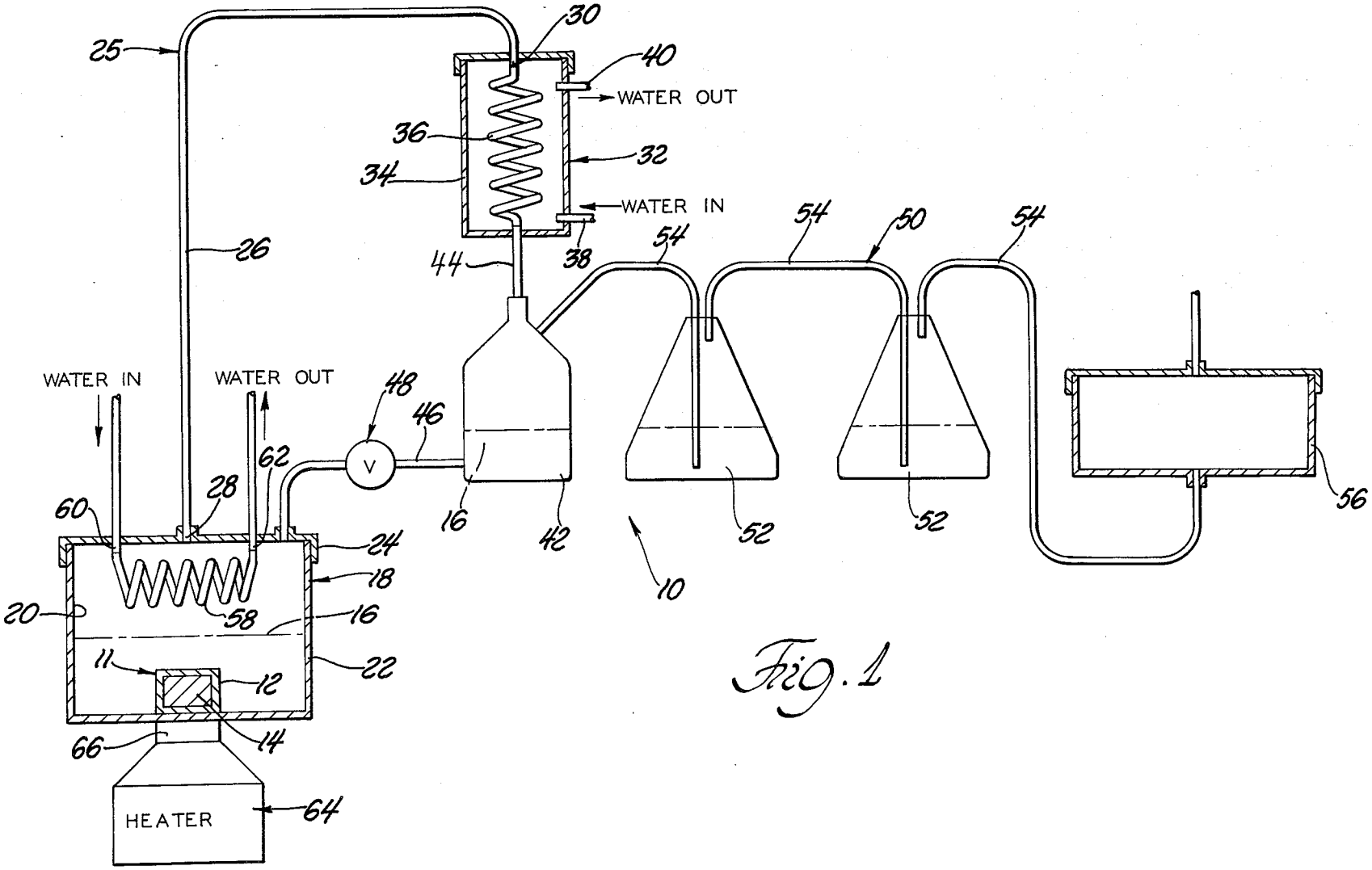
FIG. 1 is a cross-sectional schematic elevational view of the subject apparatus.
Figure 2:
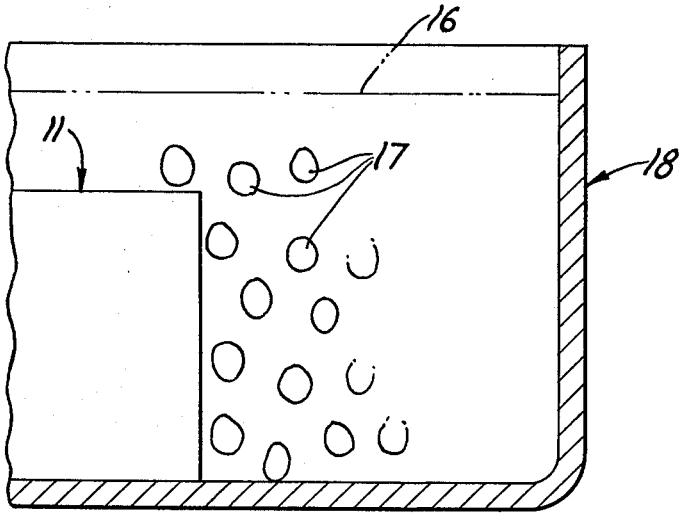
FIG. 2 is an enlarged fragmentary cross-sectional view of the subject reaction container.
Figure 3:
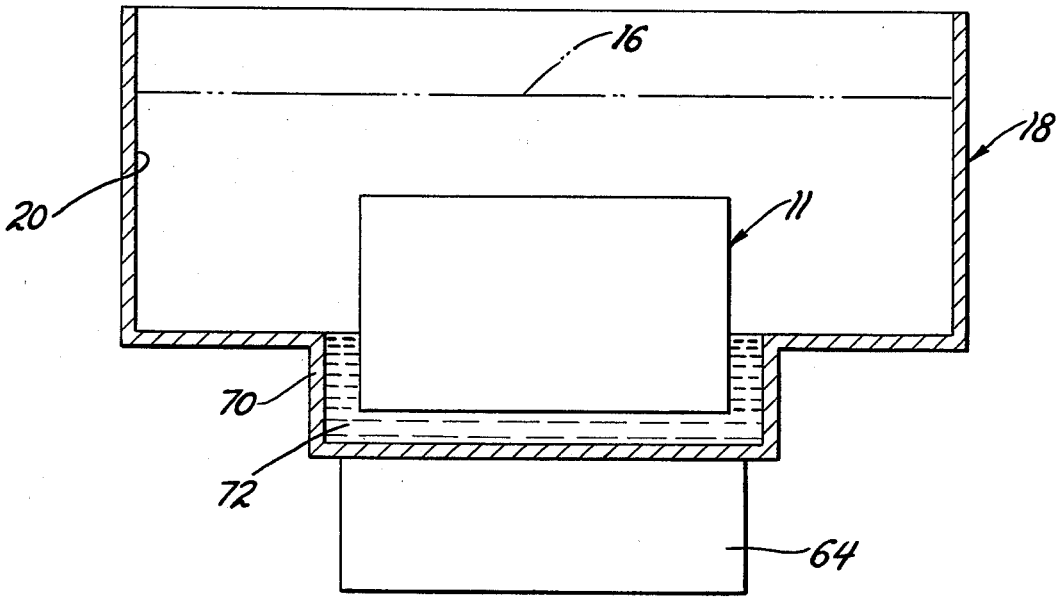
FIG. 3 is an enlarged fragmentary cross-sectional view of a second embodiment of the reaction container.

To explain the results obtained with the instant invention, a theory involves the observation that bubbles 17 are formed about the article 11 being leached during the exothermic reaction of the corrosive acid 16 with the article 11 within the reaction container 18, as shown in FIG. 2. The bubbles 17 are actually escaping gas surrounded by a layer of acid. The gas within the bubbles 17 insulate the article 11 so that the article temperature is increased above that of the surrounding acid. Accordingly, the bubbles 17 surrounding the article 11 provide an insulation about the article 11 and the insulation maintains the article 11 at a temperature significantly greater than the temperature of the surrounding acid 16. By maintaining the article 11 at a temperature above the temperature of the surrounding acid 16, the rate of the leaching reaction is increased. More specifically, the exothermic leaching reaction creates heat which increases the temperature of the surrounding acid and the article. For example, in a typical reaction, the acid can be made to boil from the heat initially generated by the reaction. The higher the temperature at the point of leaching of the corrosive layer, the greater is the leaching rate. Frequently, the outermost layer of the article 11 is leached from the article but material remains in crevices about the article 11. The generated bubbles 17 have access to these crevices and, thusly, as described above, promote the leaching reaction thereabout. However, when the outermost corrosive layer has been leached away from the article and there are no bubbles in certain areas of the article, the article will lose heat to the surrounding acid in those areas. Additionally, it is impractical to insulate the reaction container, hence, heat is lost from the acid. Thusly, the rate of the leaching reaction in the other areas still having the outermost layer therein is reduced. Accordingly, as a result of the instant invention, the article is heated above the temperature of the leaching solution to maintain and/or increase the rate of leaching reaction with the outermost corrosive layer. Consequently, the reaction rate is maintained and the residual material is leached from the article 11. In other words, the rate of the reaction is dependent upon the surface nature of the article and the appropriate external environment. The instant invention provides the appropriate external environment.

Prior art leaching systems have not provided an assembly or method in which the temperature of the article could be raised above the boiling temperature of the leaching solution so as to significantly increase the corrosion rate of the leaching reaction. The instant invention is an improvement over the prior art in that it does provide a closed system in which the temperature of the article can be raised above the boiling temperature of the leaching solution so as to significantly increase the corrosion rate of the leaching reaction.

A closed loop assembly constructed in accordance with the instant invention is generally shown at 10. The assembly 10 is adapted for dissolving a low carbon steel container 12 from a consolidated powder metal 14 by exposing the steel container 12 to a nitric acid solution 16; the nitric acid solution having a predetermined boiling temperature. The assembly can be used to dissolve other materials with various leaching solutions. For example, an aluminum layer can be dissolved with sodium hydroxide solution. Additionally, the instant invention can be used to dissolve material inside of an article. For example, the fluid die can include an inner insert disposed within the article. The instant invention can be used to dissolve the insert.

The assembly 10 includes a sealed reaction container generally indicated at 18 having an inner compartment 20 adapted to contain the nitric acid 16. The container consists of a vessel 22 for containing the acid 16 and a sealed lid or cover member 24.

A recirculation means, generally indicated at 25 is connected to the reaction container 18 for receiving boiled off leaching solution vapor and gaseous reactant products, condensing the vapor and returning the vapor to the reaction container 18. The recirculation means 25 includes a first conduit member 26 having first and second end portions 38 and 30 respectively. The first end portion 28 is operatively connected to the reaction container 18.

The recirculation means 25 further includes a condenser generally indicated at 32. The condenser is adapted for collecting the nitric acid vapor from the reaction container via the first conduit member 26. The condenser 32 includes a cooling jacket or container 34 and a cooling coil 36. The cooling coil 36 is operatively connected to or in fluid communication with the second end portion 30 of the first conduit member 26. The cooling coil 36 is disposed within the cooling jacket 34. The cooling jacket 34 is adapted to circulate coolant about the first cooling coil 36. The jacket 34 includes a coolant inlet 38 and outlet 40 adapted to be connected to a circulation system. Common coolants, such as water, can be used in this system.

The recirculation means 25 further includes a reservoir container 42 which is operatively connected to or in fluid communication with the first cooling coil 36 by a conduit 44. The reservoir container 42 is adapted to store the nitric acid 16 which is condensed in the condenser 32.

A second conduit member 46 is operatively connected between the reservoir container 42 and the reaction container 18 to establish fluid communication therebetween. The second conduit member 46 includes control means generally indicated at 48 for selectively opening and closing the second conduit 46 to control flow of the nitric acid 16 from the reservoir container 42 to the reaction container 18. In other words, the control means 48 is a valve controlling the flow of nitric acid 16 from the reservoir container 42 to the reaction container 18, thus completing the closed loop system.

Gas purification means, generally indicated at 50, are operatively connected to the reservoir container 42. The gas purification means is adapted for purifying gaseous products from the leaching of the outer layer 12 of the article 14. The gas purification means consists of various containers for removing impurities, catalytically converting dangerous gases to harmless ones, and cleaning the gases before they escape to the atmosphere. This system may include several vessels 52 containing reactant chemical liquids which neutralize and catalytically convert the reaction products to harmless ones. The vessels can contain lime-like solution for neutralizing the acid gases. The vessels 52 are interconnected by an appropriate tubing 54. Additionally, a container 56 is coupled in series with the vessels 52 and is adapted for containing solid chemical reactants, such as activated charcoal or a device similar to an automotive catalytical converter for further purifying and cleaning the gaseous products before they escape to the atmosphere.

The entire assembly 10 is subjected to corrosive fumes; hence, the interior of the chambers and vessels, as well as the conduits and tubings, must be adapted to be inert in the presence of the strong leaching solutions and chemical products of the leaching reaction. Generally, stainless steel or glass lined vessels and glass tubing are used.

A second cooling coil 58 is disposed within the inner compartment 20 of the reaction container 18. The second cooling coil 58 includes a coolant inlet 60 and outlet 62. The second coolant coil 58 provides control of the frothing of the leaching solution occurring within the container 18. When excess frothing occurs in the reaction container 18, coolant is pumped through the second cooling coil 58 to retard the frothing.

An electric resistance hot plate, generally indicated at 64, includes a heating element 66 disposed directly adjacent to the reaction container 18 for heating the article 11 above the predetermined boiling point of the nitric acid 16 so as to facilitate the dissolving of the low carbon steel container 12 from the consolidated powder metal 14. The heating element 66 engages the bottom exterior surface of the container 18 opposite to the position of the article 11 within the container. Generally, as the reaction begins, a large area of the article 11 is exposed to the acid 16. This initial external reaction can sometimes create sufficient heat so that the external heat will not be required. However, as the reaction progresses and the corrosive area of the article 11 decreases, the total heat generated by the reaction decreases. The external heat is then applied, thereby increasing the reaction rate.

Thusly, the assembly 10 provides a closed system in which the rate of the reaction between the low carbon steel layer 12 and the nitric acid 16 is increased by the raising of the temperature of the article above the boiling temperature of the nitric acid. Additionally, an environment is created in which the article is insulated to maintain the article at a temperature significantly greater than the surrounding acid.

The instant invention provides a method of dissolving a layer 12 from the article 11 by exposing the article 11 to the leaching solution 16, the leaching solution having a predetermined boiling temperature. The method includes the steps of placing the article 11 in the inner compartment 20 of the sealed reaction container 18 which contains the leaching solution 16. In other words, the article 11 is placed within the reaction chamber 18 so as to be immersed within the leaching solution 16.

The article 11 is heated to a temperature above the boiling temperature of the leaching solution 16 to increase the corrosion rate of the outer layer 12 of the article 11. If a nitric acid-water solution is used as the leaching solution, the article is raised to a temperature above 300° F. This exposure of the article 11 to the extremely high temperature increases the corrosion rate (rate of reaction between the outer layer 12 and the nitric acid 16) significantly in comparison to prior art methods wherein the temperature of the leaching solution would generally be raised from 175° F. and 200° F.

The heating element 66 of the heater is placed directly adjacent to the outer surface of the reaction container, as shown in the drawing. Alternatively, an induction coil can be placed around the reaction container 18 to heat the article 11.

Alternatively, the bottom of the reaction chamber 18 may include a recess 70 with mercury 72. The article 11 is placed in the recess 70. The heating element 64 is placed in direct contact with the outer surface of the recess 70. The article 11 is heated via conduction of heat through the mercury 72. The object in this system is to provide a minimum area of the heated mercury 72 that is exposed to the acid 16.

Another method of heating the article 11 involves disposing the article within a heating basket, the basket being electrically connected to a heat source.

All four of the aforementioned means for heating the article provides a source of heat which directly heats the article 11 to a temperature above the boiling temperature of the surrounding acid. Other methods can also be employed to accomplish the same result in accordance with the instant invention.

The boiled off leaching solution is conducted and condensed in the recirculation system 25 and selectively returned to the reaction container 18. More specifically, the boiled off leaching solution vapor is circulated from the reaction container 18 into a first cooling coil 36. A coolant, such as water, is circulated through the cooling jacket 34 and about the first cooling coil 36, thereby condensing the leaching solution 16 within the coil 36. The condensed leaching solution is collected and stored in the reservoir container 42. Finally, the leaching solution 16 is selectively returned to the reaction chamber 18 to maintain a predetermined level of leaching solution 16 within the chamber 18.

The method further includes the step of controlling the temperature within the inner compartment 20 of the reaction container 18 into a first cooling coil 36. A coolant, such as water, is circulated through the cooling jacket 34 and about the first cooling coil 36, thereby condensing the leaching solution 16 within the coil 36. The condensed leaching solution is collected and stored in the reservoir container 42. Finally, the leaching solution 16 is selectively returned to the reaction chamber 18 to maintain a predetermined level of leaching solution 16 within the chamber 18.

The method further includes the step of controlling the temperature within the inner compartment 20 of the reaction container 18 by disposing a cooling coil 58 therewithin having coolant pumped therethrough. In other words, there are two temperature controlling inputs into the reaction chamber 18; the heater 64 and the cooling coil 58. The heater is used to raise the temperature of the article 11 within the reaction chamber 18 above the boiling temperature of the leaching solution 16. If the temperature within the reaction chamber 18 rises so as to cause excess frothing of the leaching solution 16, coolant is pumped through the cooling coil 58 to retard the frothing.

Since the reaction of the leaching solution 16 with the outer layer 12 of the article generally produces gaseous products including impurities and dangerous gases, the instant method further includes the step of purifying these gaseous waste products from the condensed leaching solution within the recirculation system 25. As previously described, this step includes the passing of the gaseous waste products through a series of containers 52 for removing impurities, catalytically converting dangerous gases to harmless ones, and cleaning the gases before they escape to the atmosphere.

The invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are not to be in any way limiting, the invention may be practiced otherwise than as specifically described.

The embodiments of the invention in which an exclusive property or privilege is claimed are defined as follows:

1. A closed loop assembly (10) adapted for dissolving a layer (12) from an article (11) by exposing the article (11) to a leaching solution (16) having a predetermined boiling temperature, said assembly (10) comprising; a sealed reaction container (18) including an inner compartment (20) adapted to contain the leaching solution (16) and the article (11), and characterized by recirculation means (25) connected to said reaction container (18) for receiving boiled off leaching solution vapor and reaction gaseous products and condensing the vapor and returning the condensed vapor to said reaction container (18), said assembly (10) including heating means (64) for heating the article (11) within said reaction container (18) above the boiling temperature of the leaching solution (16).

2. An assembly as set forth in claim 1 wherein said reaction container (18) includes cooling means (58) disposed within said inner compartment (20) for selectively lowering the temperature therewithin.

3. An assembly as set forth in claim 2 wherein said recirculation means (25) includes gas purification means (50) for purifying gaseous products resulting from the leaching of the article (11).

4. An assembly as set forth in claim 3 wherein said heating means (64) includes a heating element (66) disposed adjacent the exterior of said reaction container (18) opposite to the position of the article (11) within said reaction container (18).

5. An assembly as set forth in claim 4 wherein said reaction container (18) includes a floor having a recessed portion (70), said recessed portion (70) adapted to contain mercury (72) between the article (11) and said recessed portion (70), said heating element (66) being disposed directly adjacent the exterior of said recessed portion (70).

6. An assembly as set forth in claim 4 wherein said recirculation means (25) includes a condenser (32) adapted for capturing and condensing the leaching solution vapor from said reaction container (18).

7. An assembly as set forth in claim 6 wherein said condenser (32) includes a cooling jacket (34) and a first cooling coil (36), said first cooling coil (36) being operatively connected to said reaction container (18) and disposed within said cooling jacket (34) whereby said cooling jacket (34) is adapted to circulate coolant about said first cooling coil (36) so as to facilitate the condensation of the leaching solution vapor.

8. An assembly as set forth in claim 4 wherein said recirculation means (25) includes a reservoir container (42) operatively connected to said condenser (32) for storing the condensed leaching solution collected in said condenser (32).

9. An assembly as set forth in claim 8 wherein said recirculation means (25) includes a conduit member (46) operatively connected between said reservoir container (42) and said reaction container (18) and including control means (48) for selectively opening and closing said conduit (46) to control the flow of the leaching solution (16) from said reservoir container (42) to said reaction container (18).

10. An assembly as set forth in claim 9 wherein said cooling means (58) includes a second cooling coil (58) disposed within said inner compartment (20) of said reaction container (18) and including a coolant inlet (60) and outlet (62) whereby said second cooling coil (58) is adapted for circulating coolant fluid therethrough.

11. An assembly (10) adapted for dissolving a layer (12) from an article (11) by exposing the article (11) to a leaching solution (16) having a predetermined boiling temperature, said assembly (10) comprising; a reaction container (18) including an inner compartment (20) adapted to contain the leaching solution (16) and the article (11) and characterized by heating means (64) for heating the article (11) within said reaction container (18) above the boiling temperature of the leaching solution (16).

12. A closed loop assembly (10) adapted for dissolving a low carbon steel container (12) from a consolidated powder metal (14) by exposing the steel container (12) to a nitric acid solution (16) having a predetermined boiling temperature, said assembly (10) comprising; a sealed reaction container (18) including an inner compartment (20) adapted to contain the nitric acid (16); a first conduit member (26) having a first (28) and second (30) end portion, said first end portion (28) being operatively connected to said reaction container (18); a condenser (32) adapted for collecting the nitric acid vapor from said reaction container (18) and including a cooling jacket (34) and a cooling coil (36), said cooling coil (36) being operatively connected to said second end portion (30) of said first conduit (26) and disposed within said cooling jacket (34) so that said cooling jacket (34) circulates a coolant about said first cooling coil (36); a reservoir container (42) operatively connected to said first cooling coil (36) and adapted to store the nitric acid (16) condensed in said condenser (32), a second conduit member (46) operatively connected between said reservoir container (42) and said reaction container (18) and including control means (48) for selectively opening and closing said second conduit (46) to control flow of the nitric acid (16) from the reservoir container (42) to said reaction container (18); gas purification means (50) operatively connected to said reservoir container (42) and adapted for purifying gaseous products resulting from the leaching of the article (11); a second cooling coil (58) disposed within said inner compartment (20) of said reaction container (18) and including a coolant inlet (60) and outlet (62) so that said second cooling coil (58) circulates a coolant fluid therethrough; and a heating element (66) engaging the exterior of said reaction container (18) for heating the article (11) above the predetermined boiling point of the nitric acid (16) so as to facilitate the dissolving of the low carbon steel container (12) from the consolidated powder metal (14).

13. A method of dissolving a layer (12) from an article (11) by exposing the article (11) to a leaching solution (16) having a predetermined boiling temperature, said method comprising the steps of; placing the article (11) in an inner compartment (20) of a sealed reaction container (18) which contains the leaching solution (16); conducting and condensing boiled off leaching solution vapor in a recirculation system (25) and selectively returning the collected leaching solution (16) to the reaction container (18), and heating the article (18) to a temperature above the boiling temperature of the leaching solution (16) to increase the corrosion rate of the layer (12) of the article (11).

14. A method as set forth in claim 13 including the step of controlling the temperature within the inner compartment (20) of the reaction container (18) by disposing a second cooling coil (58) therewithin and pumping coolant therethrough.

15. A method as set forth in claim 14 including the step of purifying the gaseous waste products from the condensed leaching solution within the recirculation system (25).

16. A method as set forth in claim 15 including the steps of circulating the boiled off leaching solution vapor from the reaction container (18) into a first cooling coil (36) of the recirculation system (25) and circulating a coolant about the first cooling coil (36) to condense the leaching solution (16) therewithin.

17. A method as set forth in claim 16 including the steps of collecting and storing the condensed leaching solution in a reservoir container (46) that is operatively connected to the cooling coil (36) and selectively returning the leaching solution (16) to the reaction chamber (18) to maintain a predetermined level of the leaching solution (16).

18. A method as set forth in claim 17 including the step of heating the article (16) to a temperature above 200° F.

19. A method of dissolving a layer (12) from an article (11) by exposing the article (11) to a leaching solution (16) having a predetermined boiling temperature, said method comprising the steps of; placing the article (11) in an inner compartment (20) of a reaction container (18) containing the leaching solution (16) and heating the article (11) to a temperature above the boiling temperature of the leaching solution (16) to increase the corrosion rate of the outer layer (12) of the article (11).

20. A method as set forth in claim 19 including the step of placing the heating element (66) of a heater (64) adjacent to the exterior surface of the reaction container (18) opposite to the position of the article (11).

* * * * *